US011015850B2

(12) United States Patent
Ishiyama et al.

(10) Patent No.: US 11,015,850 B2
(45) Date of Patent: May 25, 2021

(54) OIL SEPARATOR

(71) Applicant: Mitsubishi Electric Corporation, Tokyo (JP)

(72) Inventors: Hiroki Ishiyama, Tokyo (JP); Yusuke Shimazu, Tokyo (JP); Yohei Kato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/509,232

(22) PCT Filed: Oct. 23, 2014

(86) PCT No.: PCT/JP2014/078211
§ 371 (c)(1),
(2) Date: Mar. 7, 2017

(87) PCT Pub. No.: WO2016/063400
PCT Pub. Date: Apr. 28, 2016

(65) Prior Publication Data

US 2017/0276415 A1 Sep. 28, 2017

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01); *F25B 2400/02* (2013.01)

(58) Field of Classification Search
CPC .... F25B 43/02; F25B 31/004; F25B 2400/02; F25B 2400/23; F25B 2500/12;
(Continued)

(56) References Cited

U.S. PATENT DOCUMENTS 2,610,480 A 9/1952 Briscoe
3,070,977 A * 1/1963 Kimmel ..... F25B 43/02 62/192
(Continued)

FOREIGN PATENT DOCUMENTS

EP 1 724 537 A1 11/2006
JP 13-2070 B1 6/1938
(Continued)

OTHER PUBLICATIONS

International Search Report of the International Searching Authority dated Jan. 20, 2015 for the corresponding international application No. PCT/JP2014/078211 (and English translation).

*Primary Examiner* — Marc E Norman
*Assistant Examiner* — Schyler S Sanks
(74) *Attorney, Agent, or Firm* — Posz Law Group, PLC

(57) ABSTRACT

An oil separator includes a capturing member inside a main body container, which includes a first capturing member portion arranged on a side closer to an inflow pipe and a second capturing member portion being arranged on a side closer to an outflow pipe and having a porosity smaller than that of the first capturing member portion. Therefore, a driving force is generated by the capturing member having the different porosities. Through the driving force, a force of gravity, and a capillary phenomenon, oil inside the main body container is transported to an oil return pipe to prevent re-scattering of the oil, thereby being capable of suppressing reduction in oil separation efficiency. At the same time, oil return efficiency to the compressor is improved.

16 Claims, 12 Drawing Sheets

(58) Field of Classification Search
CPC ..... F25B 2500/01; F25B 2400/075; F25B 2400/16; F25B 2400/22; F25B 40/06; F25B 41/04; F25B 49/02; F25B 2341/0016; F28F 13/003; F28F 13/185; F28F 21/08; B01D 45/02
USPC ..... 62/468, 470
See application file for complete search history.

(56) References Cited

U.S. PATENT DOCUMENTS 3,564,863 A 2/1971 Sasselli
4,239,627 A * 12/1980 Wada ..... B01D 27/04 210/484
4,883,023 A * 11/1989 Tsang ..... F02M 25/12 123/25 A
5,113,671 A * 5/1992 Westermeyer ..... F25B 43/02 62/468
5,269,921 A * 12/1993 Ruger ..... B01D 29/216 210/282
5,551,253 A * 9/1996 Kim ..... F25B 31/004 55/326
5,743,926 A * 4/1998 Bannon ..... B01D 45/14 55/396
6,131,405 A * 10/2000 Griffin ..... F25B 43/02 62/470
2004/0037986 A1* 2/2004 Houston ..... A61F 2/06 428/36.9
2004/0065110 A1* 4/2004 Barratt ..... B01D 45/06 62/471
2007/0140870 A1* 6/2007 Fukanuma ..... F04B 27/109 417/269
2009/0142202 A1* 6/2009 Inoue ..... F04B 27/1081 417/313
2011/0011124 A1* 1/2011 Matsuura ..... C09K 5/045 62/468
2013/0091871 A1* 4/2013 Campbell ..... B01D 8/00 62/55.5
2016/0002518 A1* 1/2016 Taniguchi ..... C09K 5/044 252/67

FOREIGN PATENT DOCUMENTS

JP S63-022572 U 2/1988
JP H03-057393 B2 8/1991
JP H06-018865 U 3/1994
JP 2000-257994 A 9/2000
JP 2002-357376 A 12/2002
JP 2006-322701 A 11/2006
JP 2011-027293 A 2/2011
WO 2012/157762 A1 11/2012

* cited by examiner

OIL SEPARATOR

CROSS REFERENCE TO RELATED APPLICATION

This application is a U.S. national stage application of PCT/JP2014/078211 filed on Oct. 23, 2014, the disclosure of which is incorporated herein by reference.

TECHNICAL FIELD

The present invention relates to an oil separator to be used for, for example, a refrigeration circuit of an air-conditioning apparatus.

BACKGROUND ART

Hitherto, there has been known an oil separator including an oil separating chamber configured to separate oil in a refrigerant gas, a refrigerant-gas supply pipe being coupled to the oil separating chamber and having helical grooves formed in an inner wall to which the oil is caused to adhere, a refrigerant-gas discharge pipe coupled to the oil separating chamber, and an oil reservoir portion, which is provided on a bottom of the oil separating chamber and is configured to receive the oil flowing from the helical grooves formed in the inner wall of the refrigerant-gas supply pipe into the oil separating chamber (see Patent Literature 1).

In the case of this oil separator, the refrigerant gas discharged from a discharge section of a compressor to the refrigerant-gas supply pipe is supplied into the oil separating chamber through the helical grooves formed in the inner wall of the refrigerant-gas supply pipe. A centrifugal force acts during the passage through the helical grooves, resulting in adhesion of particles of oil having a large specific gravity to the helical grooves. The adhering oil flows along the helical grooves into the oil separating chamber. The oil having moved into the oil separating chamber falls down along an inner wall surface to be received in the oil reservoir portion. A certain amount of received oil is sent to a suction section of the compressor due to a difference in pressure between the suction section and the discharge section of the compressor. Meanwhile, the refrigerant gas having flowed into the oil separating chamber is sent from the refrigerant-gas discharge pipe to a condenser.

As another example, there has been known an oil separator for an air-conditioning apparatus or a refrigerating machine, which is constructed by connecting an inlet pipe to an upper portion of a main body container and connecting an outlet pipe and an oil return pipe to a lower portion of the main body container. In the oil separator, an air-guiding plate configured to guide a flow of a fluid from the inlet pipe in a direction toward an inner wall of a side portion is provided to an upper portion of an interior of the main body container, and a cylindrical mesh is installed on the inner wall of the side portion (see Patent Literature 2).

In the case of this oil separator, the refrigerant gas mixed with the oil flows into a shell of the oil separator from the inlet pipe and is changed in flow direction by the air-guiding plate so as to be guided to the mesh installed on the inner wall of the shell of the oil separator.

The oil guided to the wall of the shell is adsorbed by the mesh. The separated oil is sequentially sent down by a capillary phenomenon of the mesh to drop from a lower end of the mesh to a lower part of the shell.

As still another example, there has been known a gas-liquid separator including a two-phase refrigerant introduction port, a gas-liquid separating chamber in which two-phase gas-liquid refrigerant is introduced in a direction toward a wall surface through the two-phase refrigerant introduction port, a gas-refrigerant extraction port formed in an upper part of the gas-liquid separating chamber, and a liquid-refrigerant extraction port formed in a bottom of the gas-liquid separating chamber, in which a porous member is provided so as to be opposed to the two-phase refrigerant introduction port (see Patent Literature 3).

In the case of this gas-liquid separator, the porous member having a semi-circular cross section is provided to a wall surface portion of the gas-liquid separating chamber against which a jet of the two-phase gas-liquid refrigerant collides. The porous member is formed of a foam metal having a thickness which is sufficient to, for example, absorb a shock of the jet and being capable of absorbing the liquid refrigerant to cause the liquid refrigerant to flow downward by the capillary phenomenon.

CITATION LIST

Patent Literature

[PTL 1] JP 03-057393 B (claim 1 and FIG. 2)

[PTL 2] JP 2000-257994 A (claim 5, FIG. 5, and paragraph 0025)

[PTL 3] JP 6-18865 U (claim 1, FIG. 1, and paragraph 0024)

SUMMARY OF INVENTION

Technical Problem

However, the oil separator disclosed in Patent Literature 1 has a problem in that the oil flowing along the inner wall or the oil received in the oil reservoir portion is re-scattered due to the collision against the inner wall or due to the gas refrigerant to lower oil separation efficiency.

Only a force of gravity is used in a method of conveyance to the oil reservoir portion after the separation of oil. Therefore, there is another problem in that oil return efficiency to the compressor is low.

The oil separator described in Patent Literature 2 has a problem in that a pressure loss of the refrigerant is increased by forcibly changing the flow by the air-guiding plate after the refrigerant is discharged from the inlet pipe.

The gas-liquid separator disclosed in Patent Literature 3 has a problem in that the pressure loss of the refrigerant is increased because the two-phase gas-liquid refrigerant collides against the inner wall or the porous member after being discharged from the two-phase refrigerant introduction port.

The two-phase gas-liquid refrigerant collides against the inner wall or the porous member after being discharged from the two-phase refrigerant introduction port, and hence is likely to be re-scattered. Further, only the force of gravity is used in the method of conveying the liquid to the liquid-refrigerant extraction port, and hence the liquid is stagnant in the porous material. As a result, the re-scattering is liable to occur. Therefore, there is another problem in that the oil return efficiency is low.

Only the force of gravity is used in the method of conveying the liquid to the liquid-refrigerant extraction port. Therefore, there is another problem in that oil return efficiency to the compressor is low.

The present invention has been made to solve the problems described above, and has an object to provide an oil separator capable of suppressing re-scattering of captured oil to improve oil separation efficiency, improve oil return efficiency to a compressor, and reduce a pressure loss of refrigerant.

Solution to Problem

According to one embodiment of the present invention, there is provided an oil separator, which is to be connected to a discharge pipe of a compressor of a refrigeration circuit and is configured to separate oil contained in refrigerant discharged from the compressor from the refrigerant, including:

a main body container;

an inflow pipe having one end connected to an upper side of the main body container and another end connected to the discharge pipe, and being configured to guide the refrigerant and the oil into the main body container;

an outflow pipe having an end connected to a lower side of the main body container, and being configured to cause the refrigerant inside the main body container to flow out;

an oil return pipe having an end connected to the lower side of the main body container, and being configured to return the oil inside the main body container to the compressor; and a capturing member, which is provided on an inner wall surface of the main body container, and is configured to capture the oil flowing into the main body container through the inflow pipe, in which the capturing member includes a first capturing member portion arranged on a side closer to the inflow pipe, and a second capturing member portion being arranged on a side closer to the outflow pipe and having a porosity smaller than that of the first capturing member portion.

Advantageous Effects of Invention

According to the oil separator of the present invention, a driving force is generated by the capturing member having different porosities. The oil in the main body container is transported to the oil return pipe by the driving force, a force of gravity, and a capillary phenomenon. As a result, the re-scattering of the oil is prevented, thereby being capable of suppressing reduction in oil separation efficiency. At the same time, oil return efficiency to the compressor is improved. Further, the pressure loss of the refrigerant can be reduced.

DESCRIPTION OF EMBODIMENTS

Figure 1:
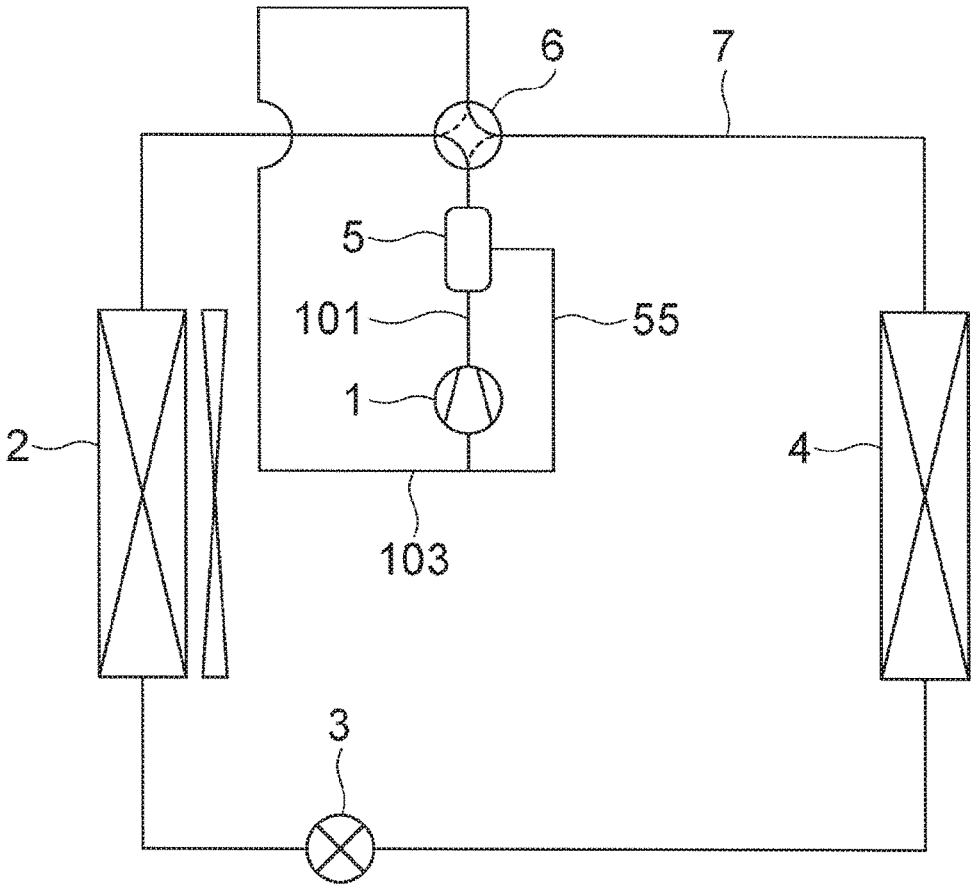
FIG. 1 is a refrigerant circuit diagram of an air-conditioning apparatus using an oil separator according to Embodiment 1 of the present invention.

Now, an oil separator according to embodiments of the present invention is described with reference to the drawings. Note that, in the drawings, the same reference symbols represent the same or corresponding members and parts.

Embodiment 1

FIG. 1 is a refrigerant circuit diagram of an air-conditioning apparatus using an oil separator 5 according to Embodiment 1 of the present invention.

The air-conditioning apparatus includes a compressor 1, the oil separator 5, a four-way valve 6, an evaporator 4, an expansion valve 3, and a condenser 2 connected via a refrigerant pipe 7 through which refrigerant flows.

During a heating operation, the four-way valve 6 (dotted lines in FIG. 1) is switched so that the refrigerant circulates the compressor 1, the oil separator 5, the four-way valve 6, the evaporator 4, the expansion valve 3, and the condenser 2 in the stated order through the refrigerant pipe 7.

Further, during a cooling operation, the four-way valve 6 (solid lines in FIG. 1) is switched so that the refrigerant circulates the compressor 1, the oil separator 5, the four-way valve 6, the condenser 2, the expansion valve 3, and the evaporator 4 in the stated order through the refrigerant pipe 7.

Figure 2:
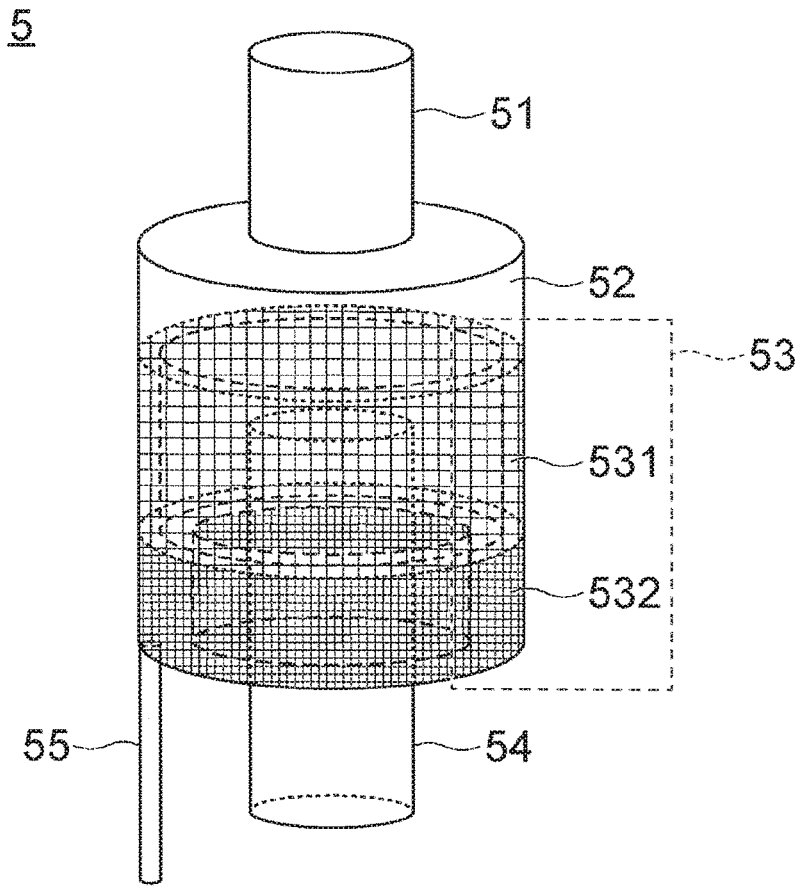
FIG. 2 is a perspective view for illustrating the oil separator illustrated in FIG. 1.

FIG. 2 is a perspective view for illustrating the oil separator 5.

The oil separator 5 includes a main body container 52 having a cylindrical shape, an inflow pipe 51, which has one end connected to an upper side of the main body container 52 and another end connected to a discharge pipe of the compressor 1 and is configured to guide gaseous refrigerant and oil into the main body container 52, an outflow pipe 54, which has an end connected to a lower side of the main body container 52 and is configured to cause the refrigerant in the main body container 52 to flow out, an oil return pipe 55 having a base end connected to a lower edge portion of the main body container 52 and a distal end extending downward in a vertical direction, and a capturing member 53, which is provided on an inner wall surface of the main body container 52 and is configured to capture the oil flowing thereinto through the inflow pipe 51.

A specific example of the capturing member 53 is, for example, a foam metal.

The capturing member 53 includes a first capturing member portion 531 arranged on a side closer to the inflow pipe 51, which is an upstream of the main body container 52, and a second capturing member portion 532 being arranged on a side closer to the outflow pipe 54, which is a downstream of the main body container 52, and having a porosity smaller than that of the first capturing member portion 531.

The outflow pipe 54, which is arranged on the same axial line as that of the inflow pipe 51, is connected to the condenser 2 via a second pipe 102.

The oil return pipe 55 is connected to a third pipe 103 between the compressor 1 and the evaporator 4.

In the oil separator 5 according to Embodiment 1, through drive of the compressor 1, high-temperature and high-pressure gaseous refrigerant and oil discharged from the discharge pipe of the compressor 1 flow into the inflow pipe 51 of the oil separator 5 through the first pipe 101 and subsequently flow into an interior of the main body container 52.

Figure 3:
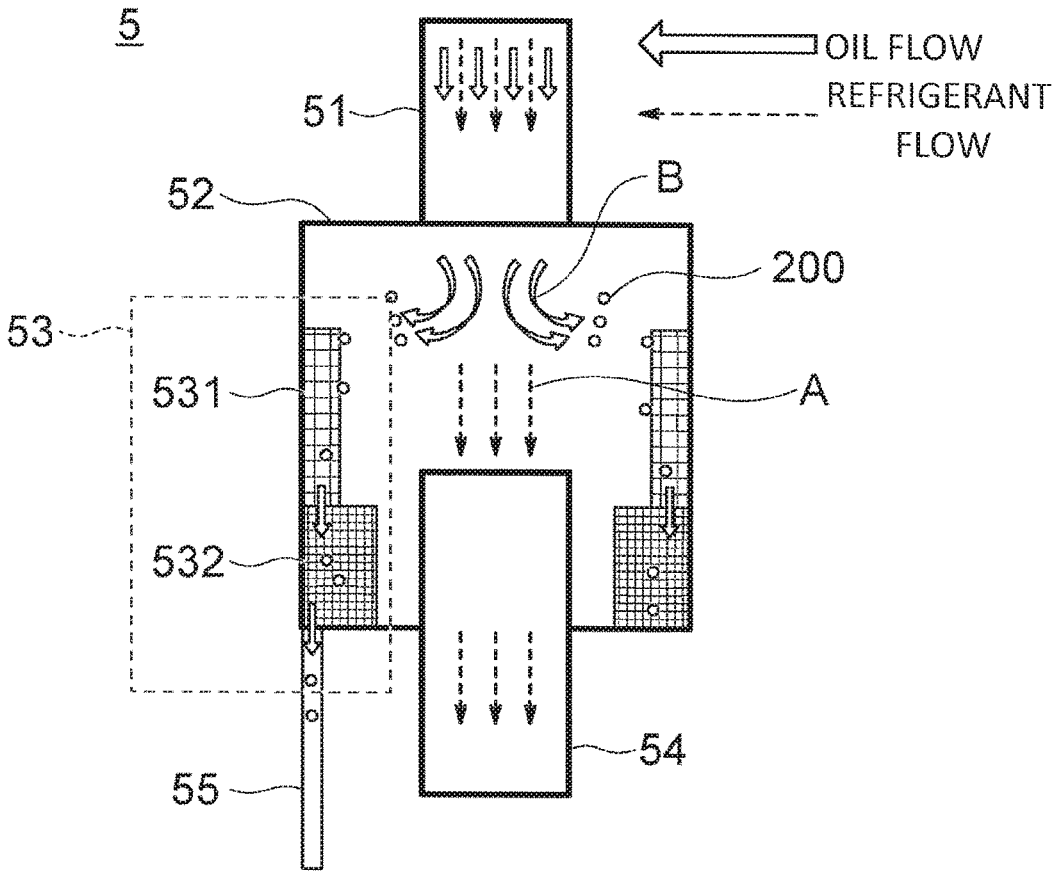
FIG. 3 is an explanatory view for illustrating movements of refrigerant and oil inside the oil separator illustrated in FIG. 1.

The refrigerant of the refrigerant and the oil having flowed into the interior of the main body container 52 flows from the main body container 52 directly into the outflow pipe 54 as indicated by the arrows A in FIG. 3 to be sent to the condenser 2.

Meanwhile, in-container oil 200 in the main body container 52 is scattered in a direction toward an inner wall of the main body container 52, as indicated by the arrows B in FIG. 3.

The in-container oil 200 scattered in the direction toward the inner wall is captured by the first capturing member portion 531 of the capturing member 53 installed on the inner wall under a surface tension and flows into an interior of the first capturing member portion 531 by a capillary phenomenon.

In the inflow in-container oil 200, a driving force from the first capturing member portion 531 having a large porosity to the second capturing member portion 532 having a small porosity is generated. Through the driving force, the capillary phenomenon, and a force of gravity, the in-container oil 200 is transported from the first capturing member portion 531 to the second capturing member portion 532.

The transported in-container oil 200 flows into the oil return pipe 55 due to a difference in pressure between the main body container 52 and the oil return pipe 55. The in-container oil 200 subsequently flows into the third pipe 103 between the compressor 1 and the evaporator 4 from the oil return pipe 55 to be returned to the compressor 1.

According to the oil separator 5 of Embodiment 1 described above, the in-container oil 200 is captured by the first capturing member portion 531. The driving force is generated by the capturing member 53 having the different porosities. Through the driving force, the capillary phenomenon, and the force of gravity, the oil is transported to the oil return pipe 55. In this manner, re-scattering is prevented, thereby being capable of suppressing reduction in oil separation efficiency. At the same time, oil return efficiency to the compressor 1 is improved.

Although an inner diameter of the inflow pipe 51 and an inner diameter of the outflow pipe 54 are smaller than an inner diameter of the main body container 52, rapid expansion of the refrigerant between the inflow pipe 51 and the main body container 52 and rapid compression of the refrigerant between the main body container 52 and the outflow pipe 54 do not occur. Thus, a pressure loss of the refrigerant is suppressed.

The inflow pipe 51 and the outflow pipe 54 are arranged on the same axial line. The refrigerant having flowed into the main body container 52 through the inflow pipe 51 flows directly into the outflow pipe 54 without any forcible change of a flow of the refrigerant inside the main body container 52. Thus, the pressure loss of the refrigerant is suppressed.

Figure 4:
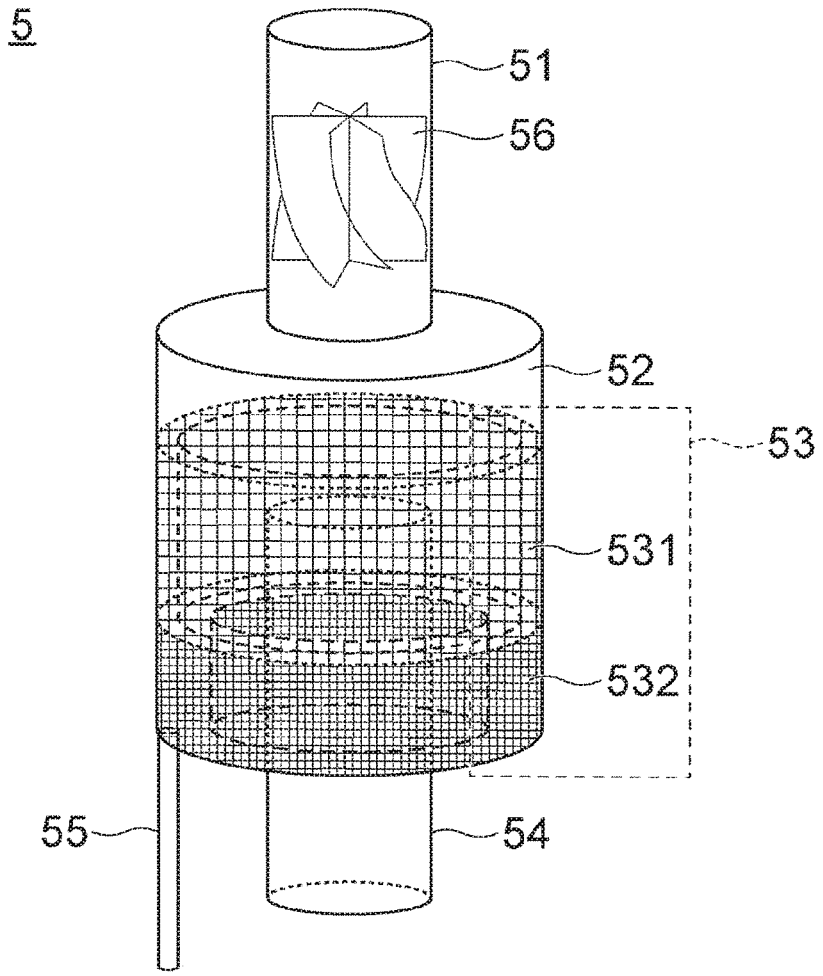
FIG. 4 is a perspective view for illustrating a first modification example of the oil separator according to Embodiment 1 of the present invention.

FIG. 4 is a perspective view for illustrating a first modification example of the oil separator 5 according to Embodiment 1 of the present invention. A swirl flow forming unit 56, which is provided inside the inflow pipe 51, and is configured to generate a swirl flow in the refrigerant and the in-container oil 200. The swirl flow forming unit 56 includes, for example, swirl vanes.

Other configuration is the same as the configuration of the oil separator illustrated in FIG. 2.

In this example, the high-temperature and high-pressure gaseous refrigerant and oil discharged by the drive of the compressor 1 flow into the inflow pipe 51 of the oil separator 5. In the refrigerant and the oil, a swirl flow is generated inside the inflow pipe 51 by the swirl flow forming unit 56, as illustrated in FIG. 5.

Figure 5:
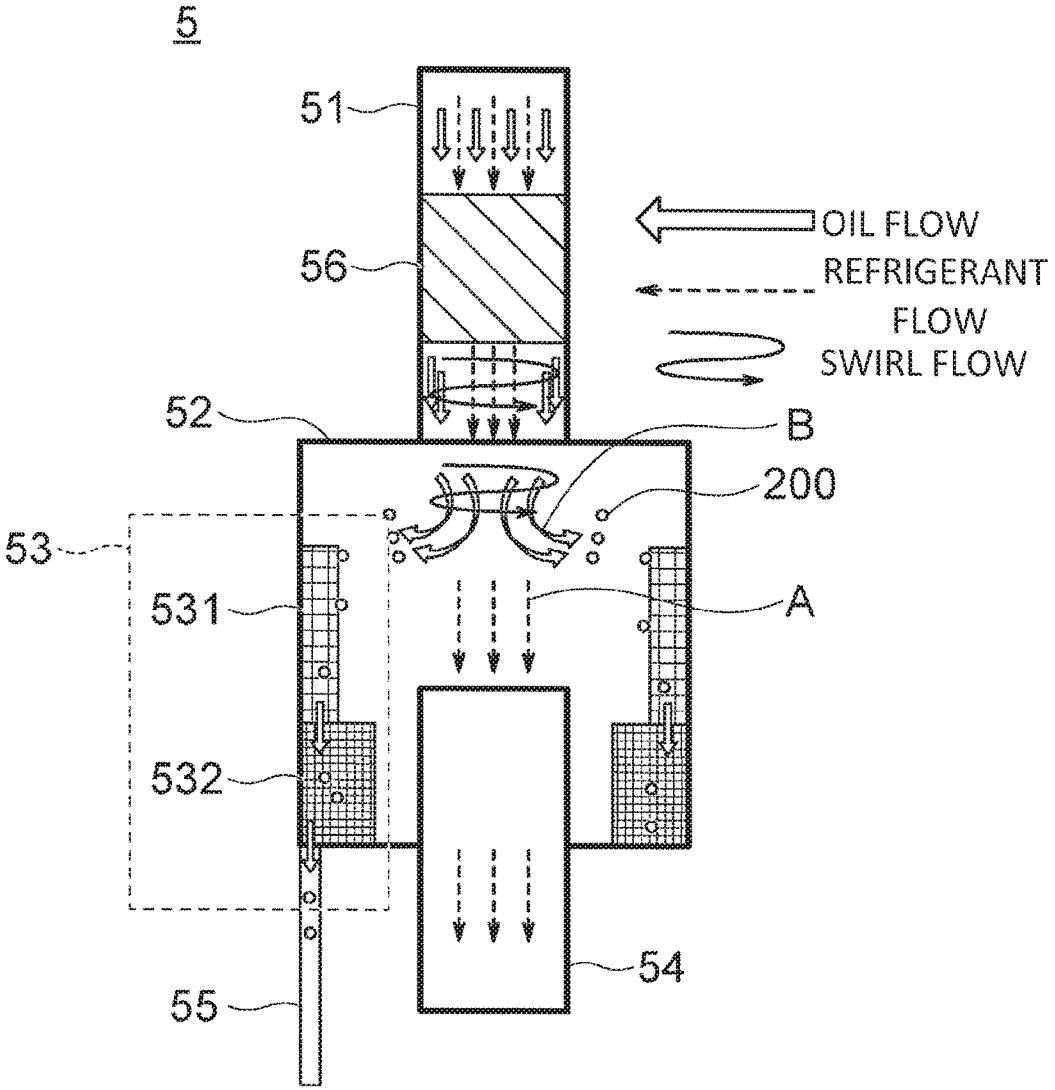
FIG. 5 is an explanatory view for illustrating movements of refrigerant and oil inside the oil separator illustrated in FIG. 4.

Then, the refrigerant of the refrigerant and the oil flowing into the interior of the main body container 52 flows from the main body container 52 directly into the inflow pipe 54 as indicated by the arrows A of FIG. 5 to be sent to the condenser 2.

Meanwhile, the in-container oil 200 inside the main body container 52 is scattered in the direction toward the inner wall of the main body container 52 by a centrifugal force of the swirl flow to be guided to the first capturing member portion 531 having the large porosity.

The guided in-container oil 200 is captured by the first capturing member portion 531 under the surface tension, and is then transported from the first capturing member portion 531 to the second capturing member portion 532 by the driving force, the capillary phenomenon, and the force of gravity.

Subsequent movement of the in-container oil 200 is the same as that in the oil separator 5 illustrated in FIG. 2.

According to the oil separator 5 of this embodiment, the in-container oil 200 is guided by the swirl flow to the first capturing member portion 531 having the large porosity. Thereafter, the in-container oil 200 is transported to the oil return pipe 55 through the same movement as in the oil separator 5 illustrated in FIG. 2. Similarly to the oil separator 5 illustrated in FIG. 2, the re-scattering of the oil is prevented, thereby being capable of suppressing reduction in oil separation efficiency. At the same time, the effect of improving the oil return efficiency to the compressor is obtained.

Figure 6:
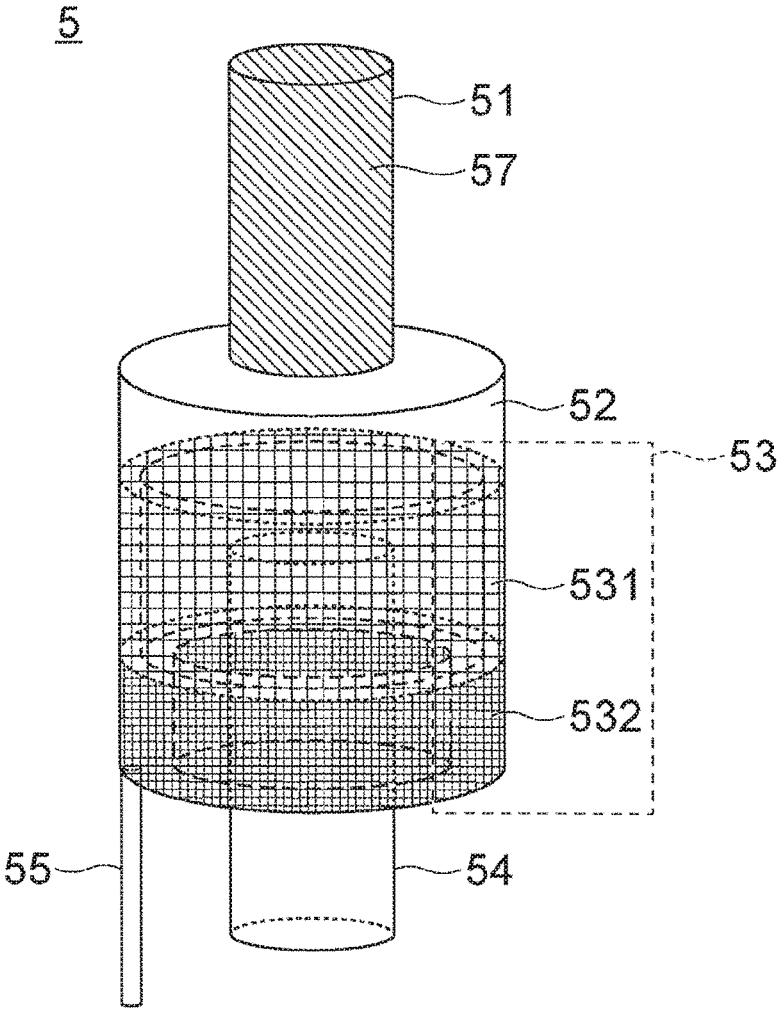
FIG. 6 is a perspective view for illustrating a second modification example of the oil separator according to Embodiment 1 of the present invention.

FIG. 6 is a perspective view for illustrating a second modification example of the oil separator according to Embodiment 1 of the present invention, in which the inflow pipe 51 is a helical-groove pipe 57 having helical grooves formed in an inner wall surface.

Other configuration is the same as the configuration of the oil separator 5 illustrated in FIG. 2.

In this example, the high-temperature and high-pressure gaseous refrigerant and oil discharged by the drive of the compressor 1 flow into the inflow pipe 51 of the oil separator 5. In the refrigerant and the oil, a swirl flow is generated inside the inflow pipe 51 being the helical-groove pipe 57 as illustrated in FIG. 7.

Figure 7:
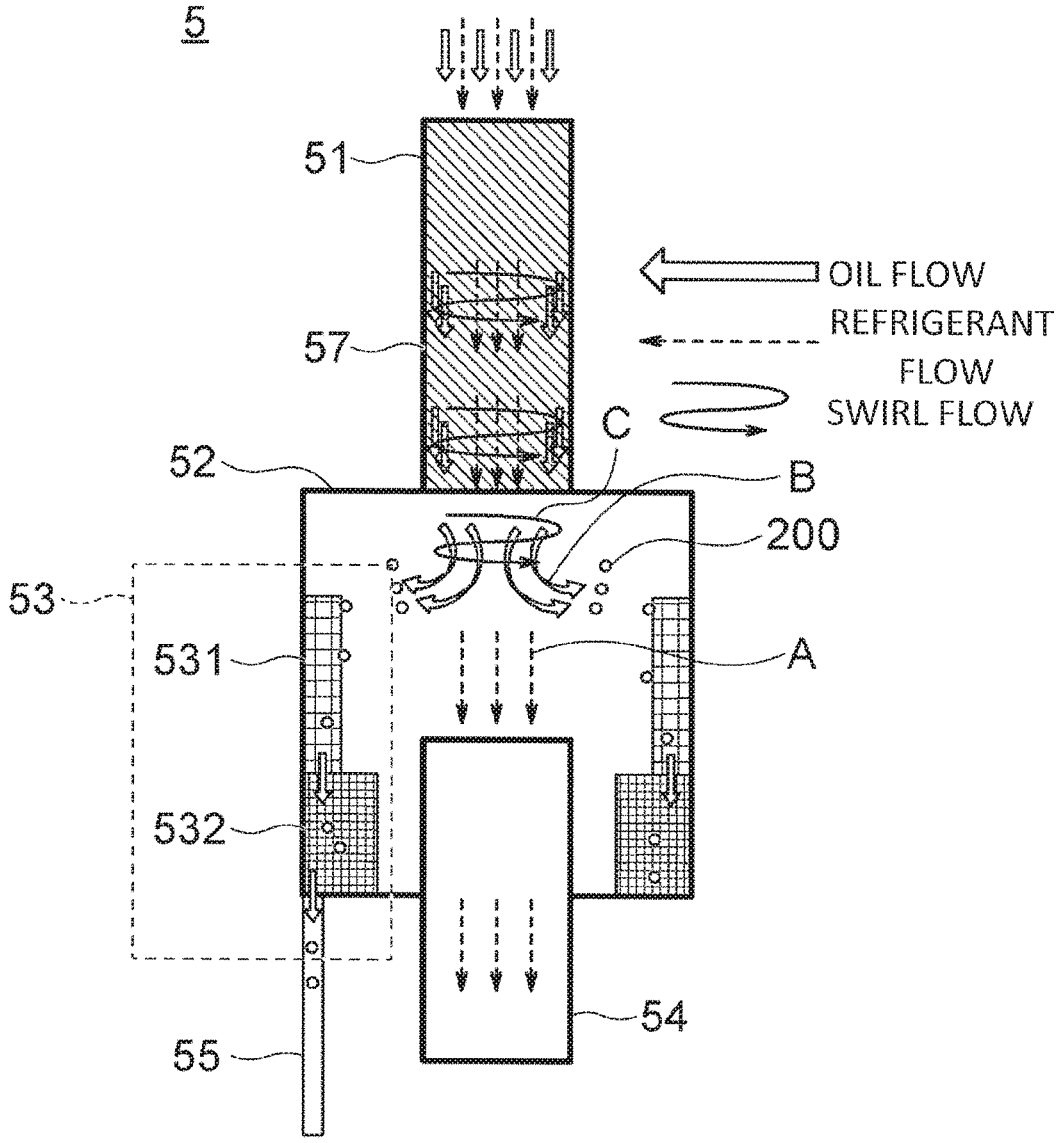
FIG. 7 is an explanatory view for illustrating movements of refrigerant and oil inside the oil separator illustrated in FIG. 6.

Then, the refrigerant of the refrigerant and the in-container oil 200 having flowed into the interior of the main body container 52 flows from the main body container 52 directly into the inflow pipe 54 as indicated by the arrows A of FIG. 7 to be sent to the condenser 2.

Meanwhile, the in-container oil 200 inside the main body container 52 is scattered in the direction toward the inner wall of the main body container 52 by a centrifugal force of the swirl flow to be guided to the first capturing member portion 531 having the large porosity. The guided oil is captured by the first capturing member portion 531 under the surface tension, and is then transported from the first capturing member portion 531 to the second capturing member portion 532 by the driving force, the capillary phenomenon, and the force of gravity.

Subsequent movement of the in-container oil 200 is the same as that in the oil separator 5 illustrated in FIG. 2.

According to the oil separator 5 of this embodiment, the helical-groove pipe 57 configured to generate the swirl flow is used as the inflow pipe 51. As a result, the same effects as those obtained by the oil separator 5 illustrated in FIG. 2 can be obtained.

Further, the swirl flow forming unit 56 including the swirl vanes is not required to be provided inside the inflow pipe 51 unlike the first modification example of Embodiment 1. Therefore, the swirl flow can be generated with a simple configuration. As a result, the pressure loss of the refrigerant inside the inflow pipe 51 can be reduced.

Figure 8:
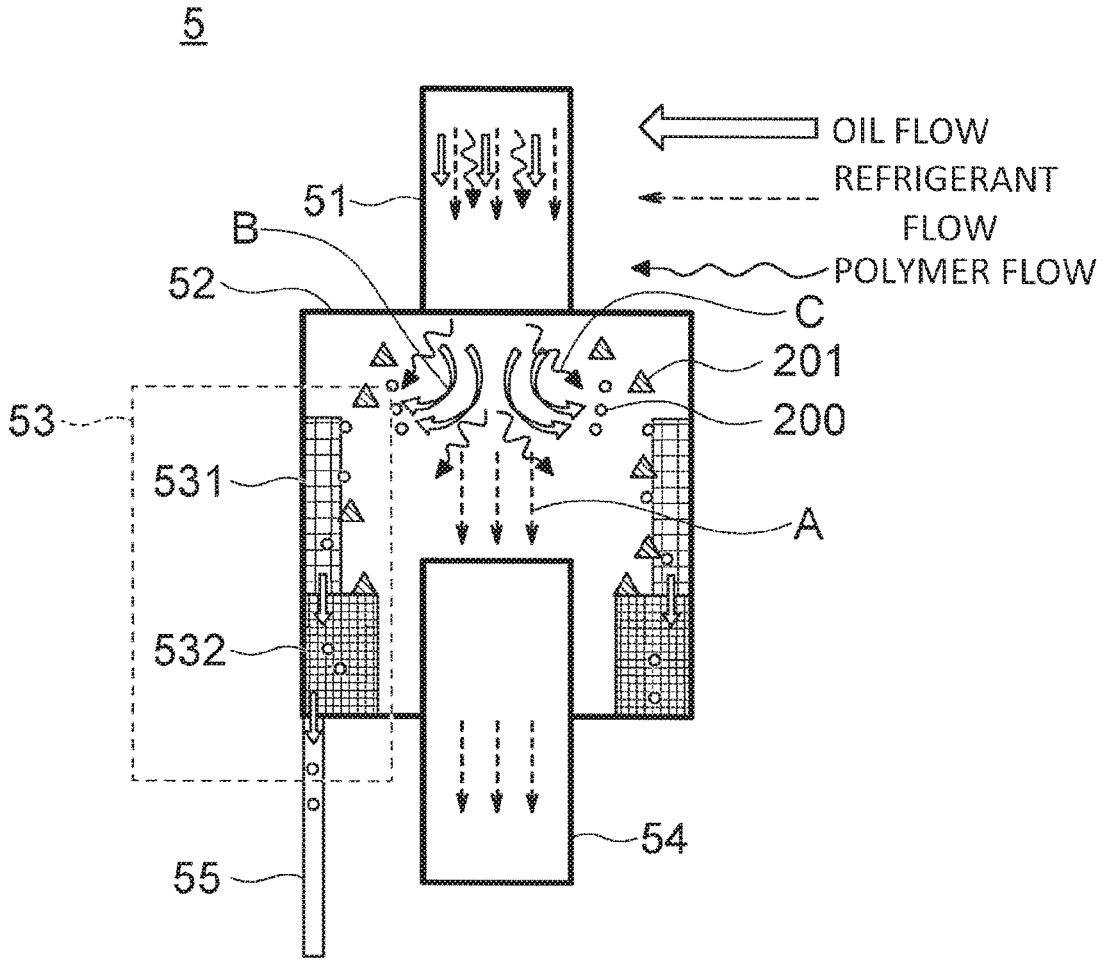
FIG. 8 is an explanatory view for illustrating movements of refrigerant, oil, and a polymer inside an oil separator, which is a third modification example of the oil separator according to Embodiment 1 of the present invention.

FIG. 8 is a perspective view for illustrating a third modification example of the oil separator 5 according to Embodiment 1 of the present invention.

In this example, in a refrigerant circuit, a refrigerant (for example, HFO-1123) having a composition which contains a polymer obtained by polymerization of double bonds is enclosed in the refrigeration circuit.

Other configuration is the same as that of the oil separator 5 illustrated in FIG. 2.

In the oil separator 5 according to the third modification example, by the drive of the compressor 1, the high-temperature and high-pressure gaseous refrigerant, oil, and polymer are discharged, flow into the inflow pipe 51 of the oil separator 5, and flow from the inflow pipe 51 into the main body container 52. Among those, the refrigerant flows from the main body container 52 directly into the outflow pipe 54, as indicated by the arrows A.

Meanwhile, the in-container oil 200, as indicated by the arrows B, and a polymer 201, as indicated by the arrows C, are scattered in the direction toward the inner wall of the main body container 52.

The oil 200 and the polymer 201 scattered in the direction toward the inner wall are captured by the first capturing member portion 531 installed on the inner wall under the surface tension. The in-container oil 200 flows down to the second capturing member portion 532 by the capillary phenomenon, whereas the polymer 201 is stored inside the main body container 52 after being captured by the capturing member 53.

In the inflow in-container oil 200, the driving force from the first capturing member portion 531 having the large porosity to the second capturing member portion 532 having the small porosity is generated. By the driving force, the capillary phenomenon, and the force of gravity, the in-container oil 200 is transported from the first capturing member portion 531 to the second capturing member portion 532.

Subsequent movement of the oil 200 is the same as that in the oil separator 5 illustrated in FIG. 2.

In this modification example, the polymer 201 is stored at the bottom inside the oil separator 5. In this manner, the polymer 201 can be prevented from flowing into the condenser 2 or the evaporator 4, thereby being capable of suppressing reduction in heat transfer performance in the condenser 2 and the evaporator 4.

Further, the polymer 201 is stored in the oil separator 5. In this manner, the polymer 201 can be prevented from flowing into the expansion valve 3, thereby being capable of suppressing reduction in control performance of the expansion valve 3.

Embodiment 2

Figure 9:
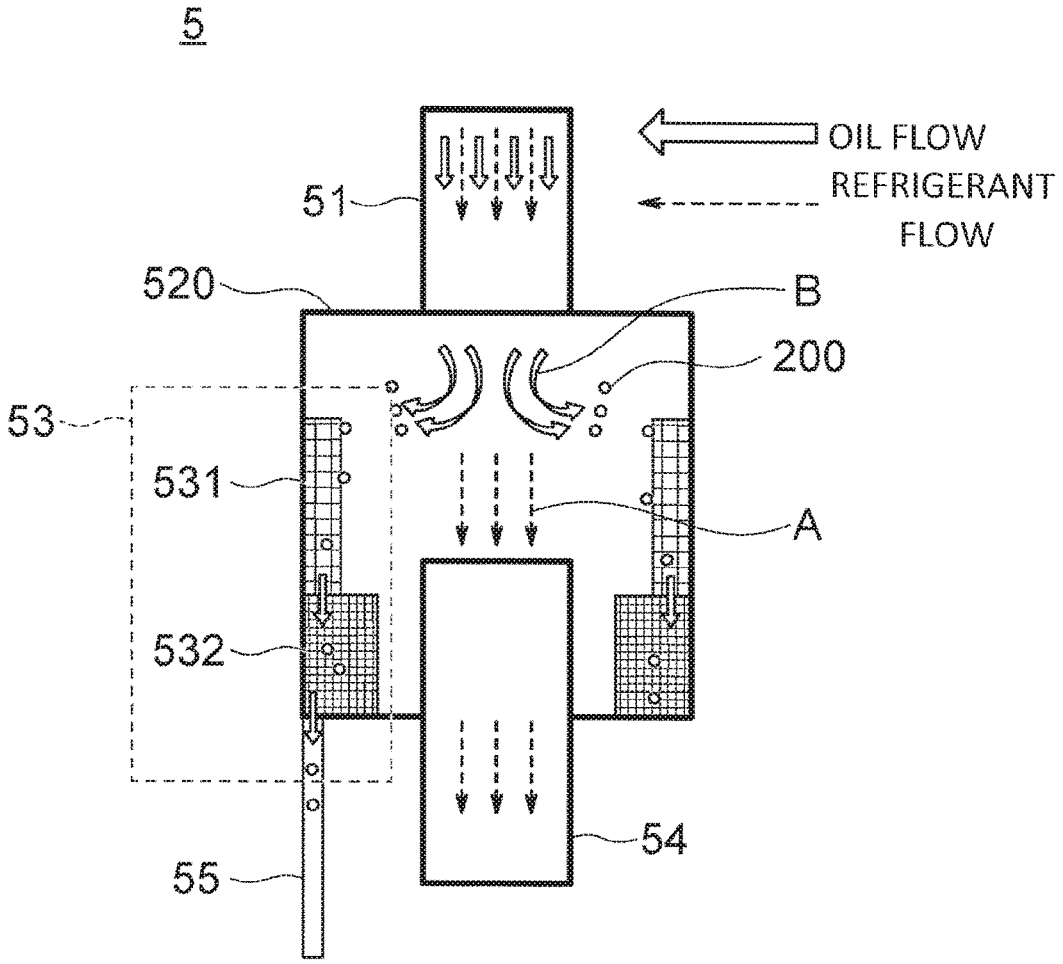
FIG. 9 is an explanatory view for illustrating movements of refrigerant and oil inside an oil separator, which is an oil separator according to Embodiment 2 of the present invention.

FIG. 9 is a configuration diagram for illustrating the oil separator 5 according to Embodiment 2 of the present invention.

In Embodiment 2, a surface area of a main body container 520 of the oil separator 5 is increased.

Figure 10:
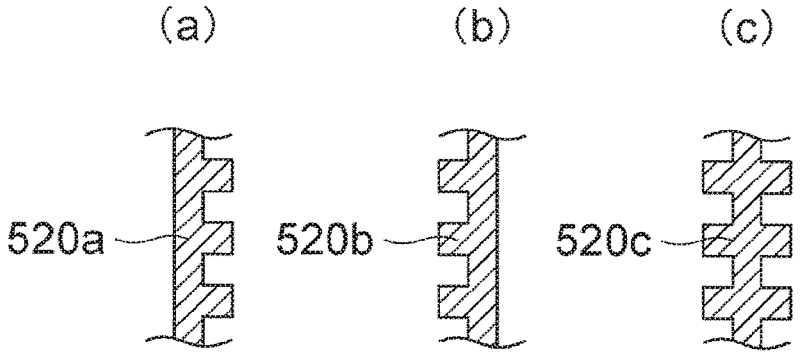
FIG. 10A, FIG. 10B, and FIG. 10C are partial sectional views for illustrating various wall portions of a main body container illustrated in FIG. 9.

As specific examples, a wall portion 520*a* having a concave and convex surface as an outer wall surface is illustrated in FIG. 10A, a wall portion 520*b* having a concave and convex surface as an inner wall surface is illustrated in FIG. 10B, and a wall portion 520*c* having concave and convex surfaces as both of the outer wall surface and the inner wall surface is illustrated in FIG. 10C.

Other configuration is the same as that of the oil separator 5 of Embodiment 1.

Movements of the refrigerant and the in-container oil 200 is the same as that in the oil separator 5 illustrated in FIG. 2.

According to the oil separator 5 of Embodiment 2, the same effects as those obtained by the oil separator 5 of Embodiment 1 can be obtained. At the same time, the in-container oil 200 returned to the compressor 1 through the oil return pipe 55 is transported by the capturing member 53 provided on the inner wall of the main body container 520. Through increase in surface area of the main body container 52, the in-container oil 200 is caused to efficiently reject heat during the transport. As a result, suction SH (degree of superheat) is not increased, thereby being capable of suppressing reduction in efficiency of the compressor 1.

Figure 11:
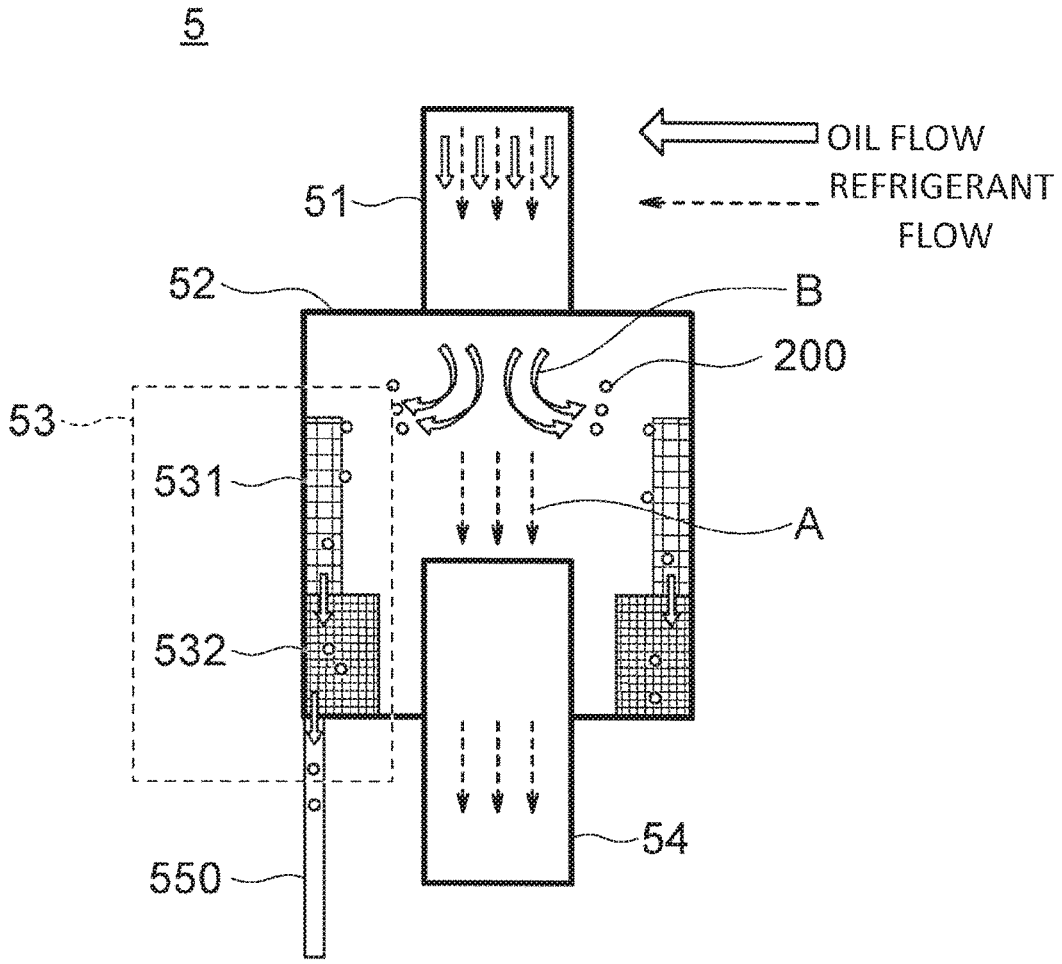
FIG. 11 is an explanatory view for illustrating movements of refrigerant and oil inside an oil separator, which is a modification example of the oil separator according to Embodiment 2 of the present invention.
Figure 12:
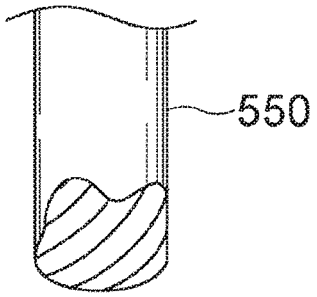
FIG. 12 is a partially cut-away view of an oil return pipe illustrated in FIG. 11.

FIG. 11 is a view for illustrating a modification example of the oil separator 5 according to Embodiment 2 of the present invention, and FIG. 12 is a partially cut-away view of an oil return pipe 550 illustrated in FIG. 11.

In the modification example of Embodiment 2, in order to increase the surface area of the oil return pipe 550, a convex and concave surface formed with helical grooves is formed on an inner wall surface of the oil return pipe 550 of the oil separator 5.

Movements of the gas refrigerant and the in-container oil 200 is the same as that in the oil separator 5 according to Embodiment 1.

According to the modification example of the oil separator 5 of Embodiment 2, the same effects as those obtained by the oil separator 5 illustrated in FIG. 2 can be obtained.

Through increase in surface area of the oil return pipe 550, the in-container oil 200 is caused to efficiently reject heat while passing through the oil return pipe 550. As a result, the suction SH (degree of superheat) is not increased, thereby being capable of suppressing reduction in efficiency of the compressor 1.

As compared to the main body container 520 illustrated in FIG. 9 in which the surface area is increased by forming the concave and convex surface on the surface, the main body container 52 has a small surface area in this example. Therefore, heat rejection of the refrigerant inside the main body container 52 is suppressed, and the refrigerant is then sent to the condenser 2. Thus, reduction in heat exchange performance in the condenser 2 can be suppressed.

The oil separator 5 used for the air-conditioning apparatus is described in each of the above-mentioned embodiments.

However, as a matter of course, the oil separator 5 is not limited thereto. The oil separator 5 can also be used for, for example, a refrigerating machine.

The capturing member 53 includes the first capturing member portion 531 and the second capturing member portion 532 in each of the embodiments described above. However, a third capturing member portion having a smaller porosity than that of the second capturing member portion 532 may be arranged adjacent to the second capturing member portion 532.

The capturing member may have the porosity continuously decreasing toward the lower side of the main body container 52.

REFERENCE SIGNS LIST

1 compressor, 2 condenser, 3 expansion valve, 5 oil separator, 6 four-way valve, 7 refrigerant pipe, 51 inflow pipe, 52, 520 main body container, 520*a*, 520*b*, 520*c* wall portion, 53 capturing member, 531 first capturing member portion, 532 second capturing member portion, 54 outflow pipe, 55, 550 oil return pipe, 56 swirl flow forming unit, 57 helical-groove pipe, 101 first pipe, 102 second pipe, 200 in-container oil, 201 polymer

The invention claimed is:

1. An oil separator, which is connected to a discharge pipe of a compressor of a refrigeration circuit and is configured to separate oil contained in refrigerant discharged from the compressor from the refrigerant, comprising:

a main body container having a cylindrical shape;

an inflow pipe being connected to an upper side of the main body container and having an end connected to the discharge pipe, and being configured to guide the refrigerant and the oil into the main body container;

an outflow pipe having an end connected to the main body container, and being configured to cause the refrigerant inside the main body container to flow out;

an oil return pipe having an end connected to a lower side of the main body container, and being configured to return the oil inside the main body container to the compressor; and a capturing member, which is at least one layer provided on an inner wall surface of the main body container, is configured to capture the oil flowing into the main body container through the inflow pipe, and is a foam metal, wherein the capturing member includes a first capturing member portion which is a first layer of the at least one layer arranged on a side closer to the inflow pipe and a second capturing member portion which is a second layer of the at least one layer being arranged on a side closer to the outflow pipe, the first capturing member having a first porosity, the second capturing member having a second porosity smaller than the first porosity, the inflow pipe and the outflow pipe are arranged on a same axial line, the refrigerant flowed into the main body container flows from the main body container directly into the outflow pipe without any forcible change of a flow of the refrigerant inside the main body container, the oil flowed into the main body container is scattered in a direction toward the inner wall surface of the main body container, the oil scattered in the direction toward the inner wall surface of the main body container is captured by a vertical inner wall surface of the first capturing member portion under a surface tension and flows through the vertical inner wall surface into an interior of the first capturing member portion by capillary action, and the first capturing member portion is arranged adjacent to the second capturing member portion, wherein in the oil flowing into the interior of the first capturing member portion, a driving force is generated by capillary action and a force of gravity which transports the oil from the first capturing member portion to the second capturing member portion.

2. The oil separator according to claim 1, wherein the inflow pipe is configured internally to generate a swirl flow in the oil and the refrigerant.

3. The oil separator according to claim 2, comprising swirl vanes provided inside the inflow pipe, that generate the swirl flow.

4. The oil separator according to claim 1, wherein the inflow pipe comprises a helical-groove pipe having a helical groove formed in an inner wall surface of the helical-groove pipe.

5. The oil separator according to claim 1, wherein at least one of the inner wall surface or an outer wall surface of the main body container has a concave and convex surface formed thereon.

6. The oil separator according to claim 1, wherein at least one of an inner wall surface or an outer wall surface of the oil return pipe has a concave and convex surface formed thereon.

7. The oil separator according to claim 1, wherein the outflow pipe is arranged on the same axis as the inflow pipe below the inflow pipe.

8. The oil separator according to claim 1, wherein the refrigerant comprises a refrigerant which contains a polymer obtained by polymerization of double bonds.

9. The oil separator according to claim 2, wherein at least one of the inner wall surface or an outer wall surface of the main body container has a concave and convex surface formed thereon.

10. The oil separator according to claim 2, wherein at least one of an inner wall surface or an outer wall surface of the oil return pipe has a concave and convex surface formed thereon.

11. The oil separator according to claim 2, wherein the outflow pipe is arranged on the same axis as the inflow pipe below the inflow pipe.

12. The oil separator according to claim 2, wherein the refrigerant comprises a refrigerant which contains a polymer obtained by polymerization of double bonds.

13. The oil separator according to claim 4, wherein at least one of the inner wall surface or an outer wall surface of the main body container has a concave and convex surface formed thereon.

14. The oil separator according to claim 4, wherein at least one of an inner wall surface or an outer wall surface of the oil return pipe has a concave and convex surface formed thereon.

15. The oil separator according to claim 4, wherein the outflow pipe is arranged on the same axis as the inflow pipe below the inflow pipe.

16. The oil separator according to claim 4, wherein the refrigerant comprises a refrigerant which contains a polymer obtained by polymerization of double bonds.

* * * * *